United States Patent [19]

Bowyer

[11] Patent Number: 4,566,508

[45] Date of Patent: Jan. 28, 1986

[54] SELF-DRAINING CLOSURE

[75] Inventor: Edward E. Bowyer, North Vernon, Ind.

[73] Assignee: Ethyl Molded Products Company, Richmond, Va.

[21] Appl. No.: 682,088

[22] Filed: Dec. 17, 1984

[51] Int. Cl.[4] ..... B65D 51/24

[52] U.S. Cl. ..... 141/381; 215/228; 215/DIG. 7

[58] Field of Search ..... 141/381; 215/228, DIG. 7

[56] References Cited

U.S. PATENT DOCUMENTS

| | | | |
|---|---|---|---|
| 218,246 | 8/1879 | Ellifrit | 141/381 |
| 2,061,685 | 11/1936 | Wheaton | 141/381 |
| 2,108,692 | 2/1938 | Pieck | 141/381 |
| 3,672,528 | 6/1972 | Faulstich | 215/320 X |

FOREIGN PATENT DOCUMENTS

| | | | |
|---|---|---|---|
| 83506 | 7/1983 | European Pat. Off. | 215/228 |
| 364528 | 12/1931 | United Kingdom | 215/DIG. 7 |

*Primary Examiner*—Donald F. Norton

*Attorney, Agent, or Firm*—Donald L. Johnson; John F. Sieberth; E. Donald Mays

[57] ABSTRACT

A one-piece plastic cylindrical closure for a container that is useful as a measuring cup. The closure has an integral internal skirt member projecting into the neck of the container which functions as a self-draining member to return residual liquid remaining in the closure to the container and to prevent this liquid from reaching the threaded exterior neck portion of the container.

2 Claims, 8 Drawing Figures

SELF-DRAINING CLOSURE

BACKGROUND OF THE INVENTION

I. Field of the Invention

This invention relates to a closure for a container which closure is adapted to be utilized as a self-draining measuring cup when removed from the container.

II. Description of the Prior Art

In the packaging of present day consumer products such as liquid detergents, liquid fabric softeners, and other liquid cleaners, it is often necessary to measure a specific amount to be added to a washing machine or other receptacle. Most users of liquid laundry and cleaning products find it generally inconvenient to keep a separate measuring cup for use in adding liquid products such as detergents, bleaches and fabric softeners to washing machines since these simple measuring cups become sticky and coated with the residue from the viscous products. Further, the measuring cups are often misplaced or lost.

In an attempt to alleviate the problems with separate measuring cups there have recently been introduced to the market liquid detergents and fabric softeners which utilize an enlarged closure cap which when removed from the product container and inverted can function as a liquid measuring cup. However, a considerable amount of consumer displeasure with such measuring cups has been encountered because the excess liquid detergent or fabric softener which adheres to the inside of the cup or closure after it is used as a measuring cup drains down the inner wall of the closure and collects in the threaded area of the neck of the container when the combination closure-measuring cup is threaded back on the container neck. After the measuring cup-closure is used a number of times, the container neck threads become clogged with dried detergent or fabric softener or other product making it difficult to remove the cap from the container and also to thread the cap onto the container after use. Each time the measuring cup closure is used, the viscous liquid remaining in the cup drains down over the threads and tends to build up on the threads and on the neck of the container.

In very early times, there was some need to have a drinking cup conveniently accessible to the container for certain products such as milk or iced beverages, etc. In U.S. Pat. No. 70,450 there is disclosed a milk can which has an inverted cup provided underneath the sealing cap flange. The cup could be removed from the can and then utilized to sample or drink milk from the can. This container was constructed of metal which complicated the construction and utilization of the container carried therewith.

U.S. Pat. No. 1,683,888 discloses a closure for a container such as a glass fruit jar or a thermos bottle. The drinking cup is attached to the underside of a metallic closure cap by means of a threaded base. Alternatively the cup could be affixed to the cap by soldering or welding. The drinking cup is inverted into the container and can extend down into the product carried in the container. Such a closure is complicated to construct and would be expensive and would not achieve the purpose needed for a measuring cup device for present day liquid detergents or similar products. Since this receptacle closure has the drinking cup extending into the product area, it would have a coating of the liquid product on the outside wall of the container where it would have to be gripped by the user.

It is well known to use preformed plastic closures which have a hollow shell or plug which extends down inside of the neck of the container and makes contact with the inner wall of the neck to provide an auxiliary liquid seal for the container. Examples of such type of container closures are seen in U.S. Pat. Nos. 2,241,846, 3,991,895 and 4,310,102. In these devices the cylindrical extension, which could be called a cup, extends down from the underside of the closure top wall. However, such hollow plugs are not utilized as a measuring device for the product in the container, but rather as an auxiliary sealing means.

The present state of the art in container closures which are useful as measuring cups does not solve the problem of product collection on the threads. There is definitely a need for a measuring-cup closure device which will provide freedom from coating the threads and the container neck with a viscous liquid product from the residual liquid contained in the measuring closure when it is inverted and threaded onto the container closure. There is a need to provide an integrally formed closure which will not require a multiplicity of forming operations or assembly in order that the measuring closure may be sufficiently economical to permit its use on relatively low cost products which do not permit use of more complicated and expensive closures.

SUMMARY OF THE INVENTION

It is the object of the present invention to provide a one-piece closure device which can be used as a measuring cup for a liquid product packaged in a container.

It is another object of the present invention to provide a closure cup for a container that is integrally formed and economical to manufacture.

It is also an object of the present invention to provide a measuring cup-closure device for a container which closure drains the residual liquid material remaining in the cup back into the container without the liquid making contact with the interior of the neck of the container.

The foregoing objects and advantages of the present invention are achieved in a novel closure for a container which container has a cylindrical neck portion. The closure includes a circular top wall portion, an integral upper sidewall portion which depends from the top wall portion and extends above the container neck portion. An integral lower sidewall portion depends from the lower end of the upper sidewall portion. Also provided are means for coupling the lower sidewall portion to the outside of the neck of the container. An integral annular collar member depends from the lower end of the upper sidewall portion and extends into the inside of the cylindrical neck portion. This collar member is spaced away from and does not make contact with the inside of the neck portion of the container.

DESCRIPTION OF THE PREFERRED EMBODIMENTS

Figure 1:
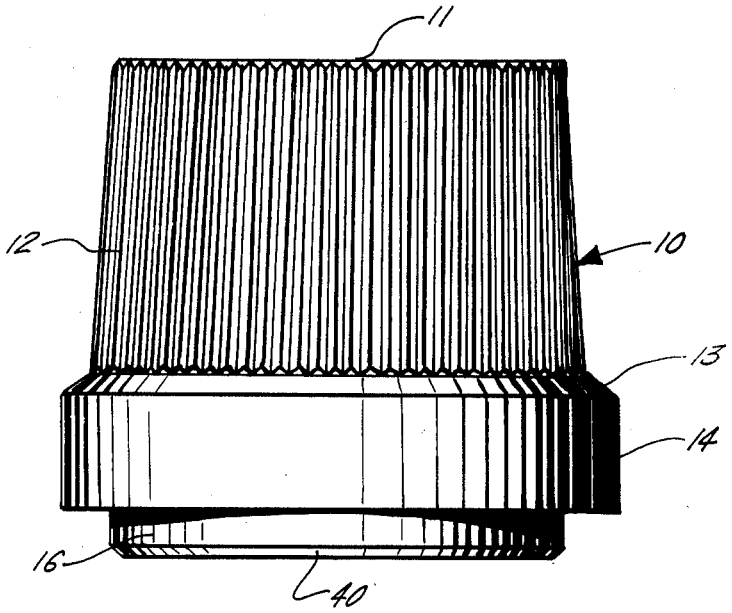
FIG. 1 is a side elevational view of a closure constructed in accordance with the present invention.
Figure 2:
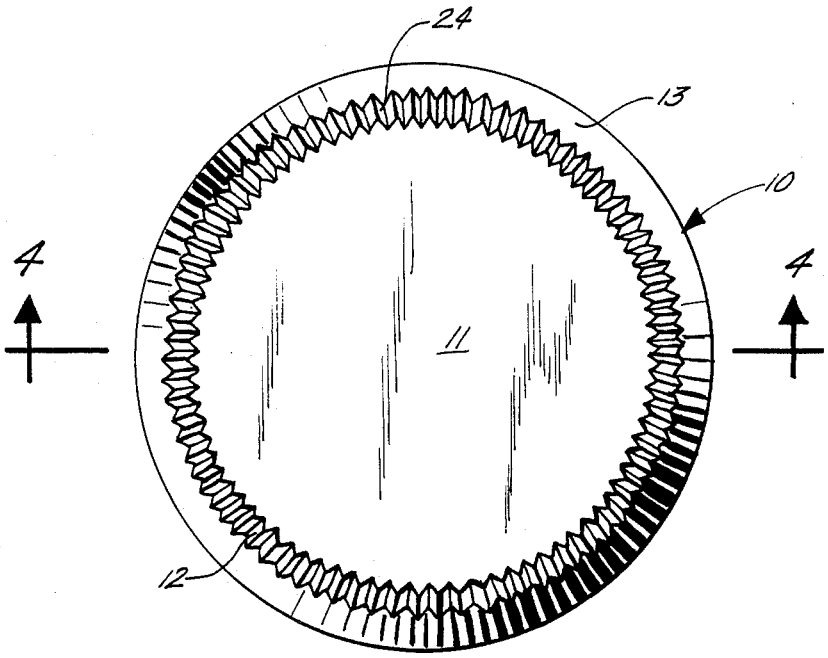
FIG. 2 is a top view of the closure shown in FIG. 1.
Figure 3:
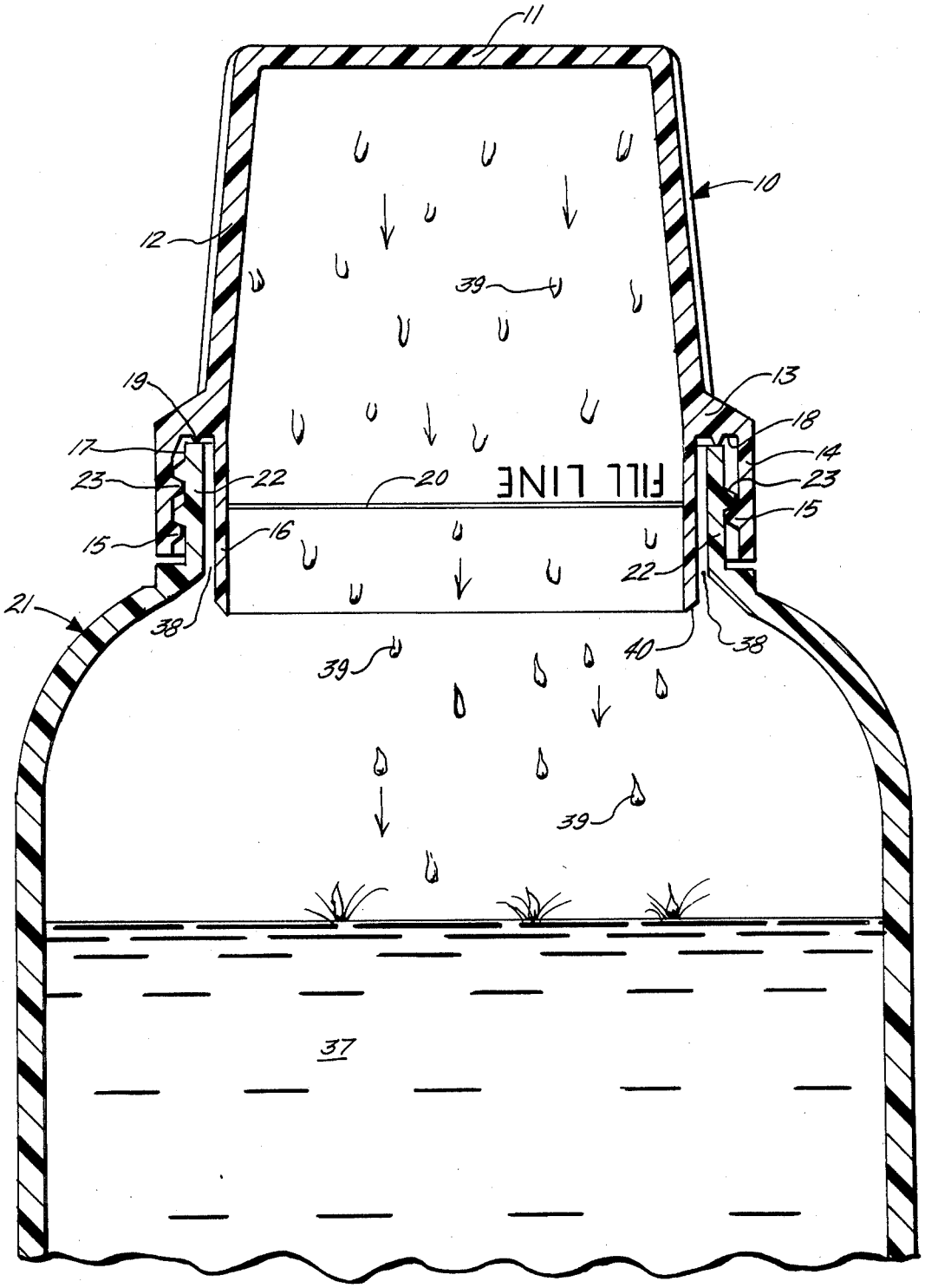
FIG. 3 is a sectional elevational view of a closure constructed in accordance with the present invention attached to a container having a threaded neck.
Figure 4:
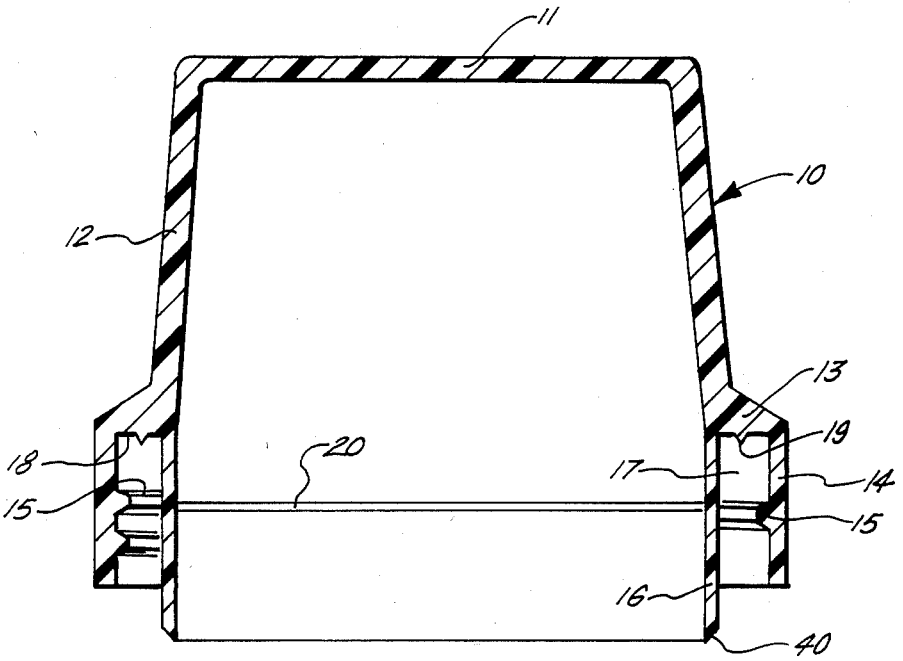
FIG. 4 is a sectional view taken along lines 4—4 of FIG. 2.
Figure 5:
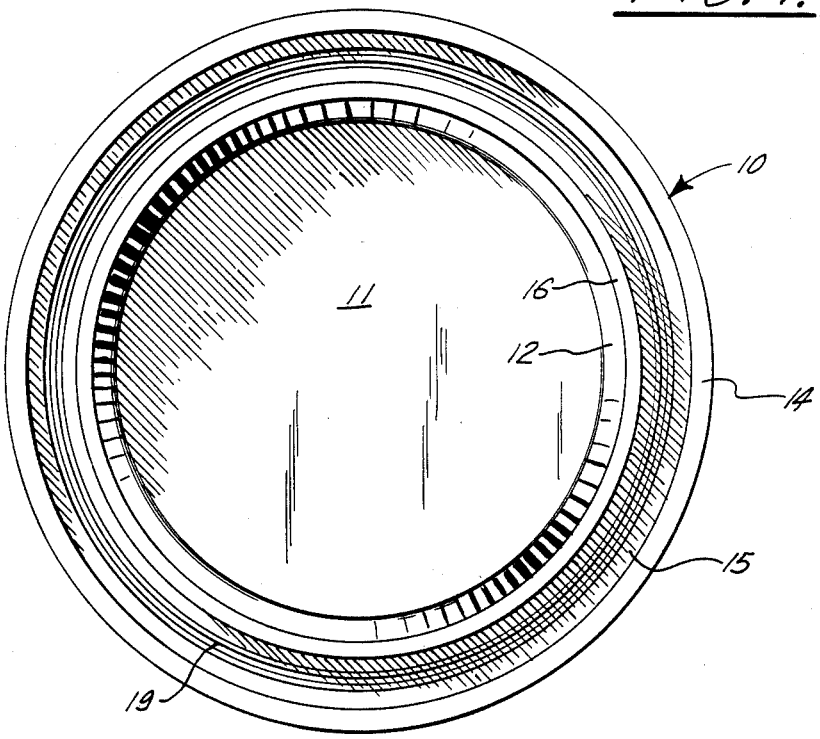
FIG. 5 is a bottom view of FIG. 1.

Referring now in particular to FIGS. 1, 2, 3, 4 and 5 one embodiment of the self draining closure of the present invention is shown. The closure, designated generally by the numeral 10, includes a generally circular top wall 11 that is attached to and integrally formed with a generally cylindrical upper sidewall portion 12. The upper cylindrical sidewall portion of the closure has an annular, outwardly and directed extension 13 integrally formed at its lower end. The annular extension 13 has integrally formed therewith a lower annular wall section 14. Helical threads 15 are provided on the inner wall of the lower wall section. While helical threads are shown in the drawing it is understood that other types of threads such as lug threads, compound threads can be used to attach the closure to the container. An annular collar 16 is integrally formed with and extends downwardly from the lower end of the upper sidewall portion 10. In the embodiment of the closure illustrated, the annular collar 16 extends down below the lower end of the lower annular sidewall section 14. As seen in FIG. 3, this annular collar 16 causes the residual product coating the sidewall of the cup to form into drops 39 that fall back into the liquid 37 in the container when the measuring closure is reattached to the container. The lower annular sidewall section 14 and the annular collar member 16 are spaced apart to provide a generally rectangular annular space 17. The upper end of the rectangular space 17 is defined by the bottom wall 18 of the annular extension 13. The wall is provided with an annular, integrally formed, downwardly projecting sealing bead 19 As seen in FIG. 4 the inner wall of the annular collar 16 is provided with a raised annular fill line bead 20 to provide a reference when the closure 10 is inverted and used as a measuring cup. The lower end of the collar 16 is provided with an inwardly beveled edge 40.

Referring now to FIG. 3, the dripless measuring cupclosure of the present invention is shown attached to a container or bottle, designated generally 21. The container is provided with a generally cylindrical neck portion 22. The neck portion 22 of the container is provided with helical threads 23 which match with and engage the helical threads 15 on the inner wall of the lower annular sidewall section 14 of the closure 10. As indicated in connection with the threads on the closure, the threads 23 on the container neck may be other than helical, i.e., they may be interrupted threads or lug threads depending upon the particular needs of the container and closure combination.

As seen in FIGS. 1 and 2, the exterior surface of the upper cylindrical 12 of the closure is provided with a plurality of evenly spaced serations 24 to assist the consumer in screwing the closure onto and off of the neck of the container. However if desired, the outer surface of the upper cylindrical sidewall 12 may be smooth, particularly if it is desired to print a message on the exterior sidewall of the upper portion of the closure.

Figure 6:
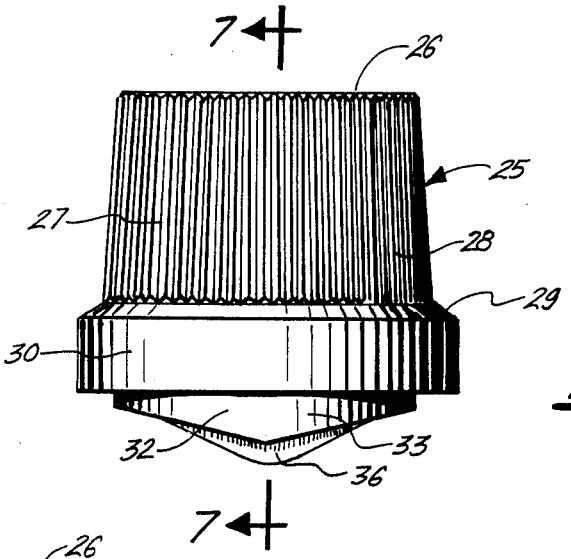
FIG. 6 is an elevational view of a second embodiment of the measuring closure of the present invention.
Figure 7:
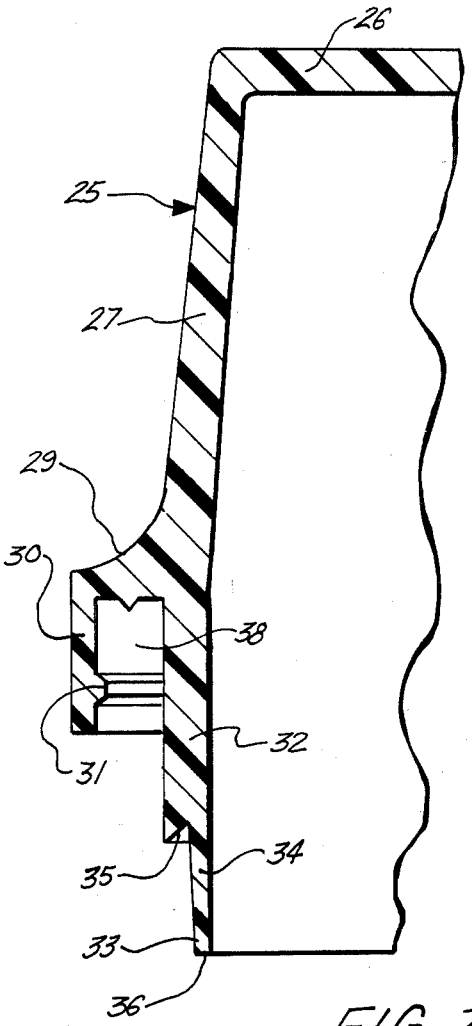
FIG. 7 is an enlarged, partial sectional view along lines 7—7 of FIG. 6.
Figure 8:
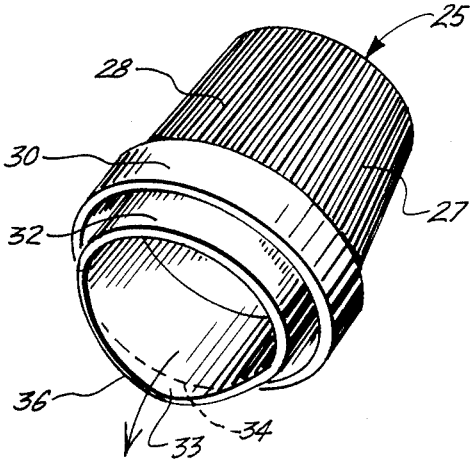
FIG. 8 is a perspective view of the container of FIG. 6 positioned for dispensing liquid contents from the measuring closure of the present invention.

Referring now to FIGS. 6, 7, and 8, there is illustrated a second embodiment of the dripless measuring closure of the present invention. In this embodiment the closure, designated generally by the numeral 25, is provided with a generally circular top portion 26 and an integrally formed, depending upper sidewall portion 27. The sidewall portion may be provided with serations 28 as seen in FIGS. 6 and 8. An integral annular extension 29 is formed on the lower end of the upper sidewall 27 and extends outwardly from the sidewall. Attached to and integrally formed with the annular extension 29 is a lower annular sidewall section 30. The lower annular sidewall 30 has provided on its inner walls a helical thread 31 for attaching the closure 25 to the container neck. A generally cylindrical annular collar 32 is integrally formed with the lower end of upper sidewall section 27 and extends downwardly therefrom. Annular collar 32 differs from that described hereinbefore in embodiment 1 in that it is provided with a generally triangular pour lip section 33 which extends downwardly from one quandrant of the circular collar 32. This can be seen more clearly in FIG. 7. The triangular pour lip 33 has a thin lower wall section 34 that is approximately one-half the thickness of the wall section of the collar sidewall 32. A generally V-shaped groove 35 is provided at the upper end of wall section 34 where it merges into the thicker upper wall section of the collar 32. The advantage of the generally triangular pour lip section 33 and the V-shaped groove 35 provided in connection therewith is its ability to prevent viscous liquid from running or moving down the side of the exterior wall of the annular collar 32 when the viscous liquid such as a liquid detergent is measured in the measuring closure and poured therefrom. By providing a relatively thin sharp lip portion 36 at the lower part of the pour lip section 33, this section is able to make a cleaner and sharper cutoff of liquid flowing over the pour lip and thus prevent any substantial amount of liquid from running down the outside surface of the collar 32 and ultimately filling the rectangular area 38 defined by the lower annular sidewall 30 and the upper wall portion of the annular collar member 32. When liquid product collects in this area it will of necessity fill and obstruct the threads 31 and cause a transfer of the product to the threaded neck where it can dry and prevent the closure from being easily removed from the bottle neck.

Referring now to FIG. 3, the self-draining closure of the present invention is of a sufficient size to be utilized as a measuring cup to measure the appropriate quantities of a particular liquid product carried in the container. The closure is generally sized in order to provide the appropriate measuring capacity for the most commonly used products requiring such measurement, i.e., liquid detergents and fabric softeners, liquid soaps and other consumer-type products. The container will generally be provided with a adequate size neck opening to accommodate a dripless container closure of the appropriate size. Before the initial shipment of the containter to the retail store and ultimately to the purchasing consumer, the closure is applied to the container with sufficient torque to insure that the sealing bead 19 seats firmly against the top of the lip on the neck portion 22. In its initial shipped position and in its storage position with the consumer this provides a primary seal to prevent the product from leaking into the portion of the rectangular space 17 that is occupied by the external threads 23 on the container neck and the threads 15 on the inner wall of the lower sidewall section 14. As indicated before, it is desirable to prevent liquid from reaching these areas to prevent frozen-on closure caps, unsightly and leaking closures.

In operation the consumer unscrews the closure 10 from the container 21 and inverts the closure so that its open end is facing upwardly and then fills the measuring dripless container 10 with the liquid contents 37 out of the container 21. The liquid product, i.e., liquid detergent, fabric softener, etc. is then added to the appropriate receptacle, i.e., washing machine. Immediately after use as a measuring container, the closure 10 is reinverted and screwed onto the neck of the container. Any residual product, particularly the more viscous detergents and fabric softeners, will produce a film on the inside of the . measuring closure 10. In prior art measuring closures, the residual product that remained in the container closure and ultimately drained down the interior sidewalls and became lodged in the area occupied by the threads of the container and the closure cap. This caused the container closure to "freeze closed" after a number of uses because of the heavy deposit of dried detergent on the threads of the measuring container and the threads of the measuring-closure cap.

The neck closure of the present invention avoids the foregoing problems by preventing any residual liquid product from entering the thread area on the exterior of the neck of the container. As seen in FIG. 3, after the closure 10 is used as a measuring cup, it is returned to the top of the container and threaded back thereon to provide a liquid seal. The layer of viscous product remaining on the inside walls of the closure drains back into the container and is prevented from reaching the critical threaded area on the exterior of the neck of the container. As seen in FIG. 3, the residual product 39 adhering to the walls of the closure 10 ultimately drains back directly into the container by dripping off the lower edge of the annular collar 16. As seen in FIG. 3, the annular collar 16 has an outside diameter which is smaller than the inside diameter of the neck portion 22 of the container. By maintaining this size differential, a generally cylindrical airspace 38 is maintained between the exterior of the collars 16 and 32 and the interior surface of the neck portion 22 of the container. Due to the collars 16 and 32 having the smaller diameter and the provision of the airspace, any liquid that drains back from the interior of the measuring cup closure is prevented from dripping into the neck area of the bottle as is the case with prior art measuring closures. As seen in FIG. 3, the liquid will drain back down the inner wall of the closure 10 and form into drops 39 which will fall directly back into the liquid 37 in the container.

The second embodiment of the measuring dripless closure of the present invention seen in FIGS. 6, 7, and 8 has the added advantage of preventing liquid from running down the outer walls of the collar portion 32 of the measuring closure by virtue of its triangular shaped pouring lip and the V-shaped groove 35 which traps any residual fluid that might run down the outer surface of the thin wall section 34 of the pour lip 33.

The measuring dripless closure cap of the present invention can be formed from any thermoplastic which can be injection molded. Among the many thermoplastics which can be utilized for manufacture of the present measuring dripless closure is high density polyethylene, polypropylene, ABS, high impact polystyrene, nylon, and any other suitable thermoplastic material.

The invention has been described in preferred embodiments which should not be limited to that described and illustrated. It is understood that modifications may be made thereto which are within the ability of those skilled in the art and the invention described herein should be limited only by the scope of the claims contained herein.

I claim:

1. A closure for a container having a cylindrical neck portion comprising:

(a) a circular top wall portion;

(b) an integral upper sidewall portion depending from said top wall portion and extending above said container neck portion;

(c) an integral lower sidewall portion depending from the lower end of said upper sidewall portion;

(d) mean for coupling said lower sidewall portion to the outside of said neck of said container;

(e) an integral annular collar member depending from said lower end of said upper sidewall portion and extending into the inside of said cylindrical neck portion and spaced away from said inside of said neck portion;

(f) a generally triangular shaped pour lip extension integral with the lower end of said annular collar member and which has a reduced thickness compared thereto.

2. The closure of claim 1 wherein a generally V-shaped groove is provided at the intersection of said pour lip and said annular collar member.

* * * * *